United States Patent [19]

Bergling et al.

[11] Patent Number: 4,563,857

[45] Date of Patent: Jan. 14, 1986

[54] METHOD AND APPARATUS FOR STRETCH FILM WRAPPING OF GOODS AGGREGATES

[75] Inventors: Jan K. A. Bergling; Ralph H. Widenbäck, both of Jönköping, Sweden

[73] Assignee: TRIO-LENG Pac System AB, Jönköping, Sweden

[21] Appl. No.: 631,094

[22] Filed: Jul. 16, 1984

[30] Foreign Application Priority Data

Jul. 21, 1983 [SE] Sweden ..... 8304084

[51] Int. Cl.[4] ..... B65B 11/04

[52] U.S. Cl. ..... 53/399; 53/441; 53/448; 53/543; 53/556; 53/587; 53/593

[58] Field of Search ..... 53/399, 441, 448, 556, 53/587, 588, 593, 543

[56] References Cited

U.S. PATENT DOCUMENTS

| | | | |
|---|---|---|---|
| 931,631 | 8/1909 | Milhado | 53/399 |
| 2,612,737 | 10/1952 | Thielms | 53/593 X |
| 4,376,364 | 3/1983 | Horino | 53/587 |
| 4,461,136 | 7/1984 | Hudson | 53/587 X |

FOREIGN PATENT DOCUMENTS

| | | | |
|---|---|---|---|
| 76248 | 6/1976 | Australia | 53/441 |
| 32140 | 7/1981 | European Pat. Off. | 53/588 |
| 2383074 | 11/1978 | France | 53/587 |

*Primary Examiner*—John Sipos

*Attorney, Agent, or Firm*—Burns, Doane, Swecker & Mathis

[57] ABSTRACT

A method for stretch film wrapping of goods aggregates (6) in a line operation including keeping the stretch film tensioned between a ready-wrapped goods aggregate and a stretch film store, and forming a new goods aggregate (6) by moving at least two articles towards each other and into contact with either side of the stretch film so that the stretch film is clamped between the articles (4) in the new goods aggregate. The stretch film can then be parted between the new goods aggregate and the ready-wrapped goods aggregate (6'), after which the new goods aggregate (6) is wrapped with stretch film with the aid of a conventional wrapping means. An apparatus for carrying out the method includes, apart from a conventional stretch film wrapping apparatus, means (8) for ejecting a wrapped goods aggregate (6') from the wrapping station.

means (17) for building up the goods aggregate (6) by moving at least two articles (14) towards each other on either side of the stretch film between the stretch film store (4) and the ready-wrapped goods aggregate (6'), so that the stretch film is anchored in the new goods aggregate (6).

14 Claims, 3 Drawing Figures

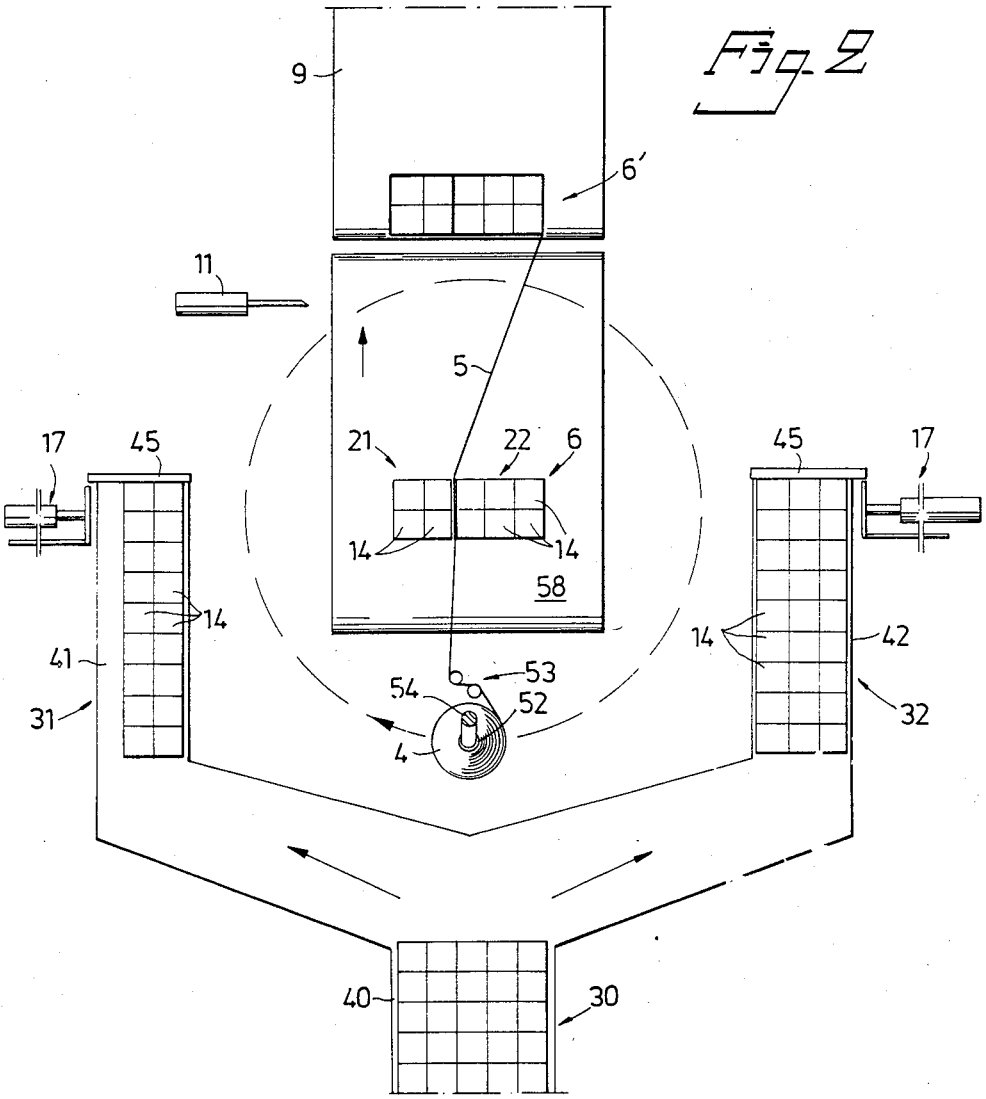
Fig. 2
Fig. 3
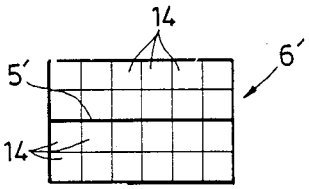

METHOD AND APPARATUS FOR STRETCH FILM WRAPPING OF GOODS AGGREGATES

TECHNICAL FIELD

The invention relates to a method for stretch film wrapping of goods aggregates, each containing at least two articles. The method provides that a goods aggregate is arranged in a wrapping station, that tensioned stretch film is wound round the goods aggregate in the station during withdrawal of the film from a film store, that the wrapped goods aggregate is removed from the station, that a new goods aggregate is moved into the station, that the film portion extending between the wrapped aggregate and the store is anchored at the new goods aggregate and that the film is then cut between the new and the wrapped aggregate.

The invention also relates to an apparatus for carrying out the method. The apparatus includes means for wrapping tensioned stretch film round a goods aggregate in a wrapping station while withdrawing the stretch film from a film store, means for discharging the wrapped goods aggregate from the station, means for taking a new goods aggregate into the station, means for anchoring the film to the new goods aggregate, and means for parting the stretch film between the wrapped aggregate and the new aggregate after the film has been anchored to the new aggregate.

BACKGROUND

The technique mentioned above and from which the invention is developed is previously known, e.g. from the patents FR No. 2 383 074 or SE No. 8000140-7. In the technique according to the cited patents, the film is anchored to the new goods aggregate by the film being wound a turn with overlap round the aggregate.

The known technique is complicated, however, and requires extensive means for guiding the film wrapping movement, or complicated devices for manipulating the film web for anchoring it, and the film cannot be parted before the first wrapping turn.

The invention may be regarded as being based on the technique mentioned, and has the object of providing an improved and simplified anchorage of the stretch film to the new goods aggregate which is to be wrapped with the stretch film. A further object is to provide a method and apparatus allowing parting the film before the wrapping of film round this aggregate has taken place. A further object is to provide a method and apparatus which, with the aid of the film anchorage, provides improved holding together of the articles in the goods aggregate in the ready-wrapped goods aggregate.

CHARACTERIZATION OF INVENTION

The method is based on the technique already known, is apparent from the preamble to the accompanying claim 1, and is distinguished in that the new goods aggregate is formed by moving at least two articles together in a direction towards each other and into contact with either side of the stretch film, which cohesively extends between the stretch film store and the unit wrapped with stretch film, so that the film is anchored by being clamped between the items in the newly formed aggregate. The goods aggregate is usually formed by moving two groups of articles towards each other. The article groups may each contain a plurality of articles. The goods aggregate can thus include an article matrix, e.g. of 4×6 articles. The stretch film, which is generally wound horizontally round the goods aggregate with the plane of the film vertical is preferably somewhat sticky and affords adhesion to the peripheral articles of the matrix. By the anchorage end portion of the stretch film extending through the article matrix, i.e. through the goods aggregate to its entire length or width, the anchorage end portion of the stretch film affords keeping together of the inner articles of the matrix, due to the stickiness of the film.

The goods aggregate can be formed by moving the articles together while the film is anchored in the formed goods aggregate in a position outside the wrapping station, and then moved from the position in which the goods are put together and anchored to the wrapping position in a separate operational step. However, it should be clear that to advantage the goods aggregate can be formed and the film anchored to it in the film wrapping station or position in itself.

An article flow can be divided into two article flows from which articles or article groups are removed for putting together into a goods aggregate as described above.

The inventive apparatus is based on apparatus of the kind apparent from the preamble to the accompanying apparatus claim, and is essentially distinguished in that the anchoring means include means for moving at least one article towards each side of the film between the ready-wrapped aggregate and the film store, the moving means being adapted for clamping the film between the articles in the new goods aggregate. The moving means may comprise means for taking the aggregate into the wrapping station. The moving means can be arranged for building the goods aggregate and anchoring the stretch film in it in a position separate from the stretch film wrapping station. In such a case there may be a conveying means, e.g. a pushing means, arranged to transfer the goods aggregate with anchored film from the position where the aggregate is built up to the position where wrapping takes place. The discharge means can be adapted to be said conveying means. As in the prior art, the film wrapping means can comprise a turn-table, carrying the goods aggregate for rotation, there being a stationary holder for the film store (usually consisting of a roll of stretch film) and possible film web brakes or a conventional means for orbiting the film store with possible film web brakes round the film wrapping station and the goods aggregate therein. The apparatus is preferably such that when the articles are moved together to form the goods aggregate while the film web is anchored, the film store and the ready-wrapped goods aggregate are in such positions that the stretch film extends generally in a direction at right-angles to the operational direction of the moving means.

The apparatus can further include two conveyors, with the aid of which an article flow is advanced and divided into two part flows, each of which is advanced in predetermined order to a respective moving means, these means being adapted to urge a desired number of articles towards said film web for building the goods aggregate and anchoring the stretch film to it.

The previously mentioned objects are achieved by the method and apparatus in accordance with the invention. There is further gained the advantage that it is possible to eliminate the need of a support tray for the goods aggregate. Such trays are normally necessary in the prior art when wrapping together a plurality of articles into goods aggregates.

The articles are for example such as cylindrical preserving cans, parallelepipedic for liquids etc.

The articles anchor the stretch film by clamping it between themselves in the collected aggregate, the stickiness of the stretch film improving the strength of the anchorage. The article groups which are moved together can be stacked one upon the other so that the goods aggregate includes a matrix including several courses of articles. In accordance with the invention, the stretch film is preferably adapted with its plane substantially in the vertical plane, and the articles are conveyed along substantially horizontal surfaces.

The stretch film wrapping means may conventionally include a pressure platen, which is pressed against the upper surface of the goods aggregate so that the anchorage of the film in the aggregate and the stability of the latter is ensured before and during the initial step of the wrapping operation.

Stretch film is normally wrapped solely as a girdle lying in the horizontal plane round the goods aggregate, it being of course possible to arrange the stretch film wrapping to extend substantially over the entire height of the goods aggregate.

The invention is defined in the accompanying claims.

The invention will now be described in detail in conjunction with examples of the stretch film wrapping apparatus which are not to be regarded as restricting, and with reference to the appended drawing.

DRAWING

FIG. 2 illustrates another stretch film wrapping apparatus in accordance with the invention. FIG. 3 illustrates an example of a goods aggregate packed in accordance with the invention.

EMBODIMENTS

Figure 1:
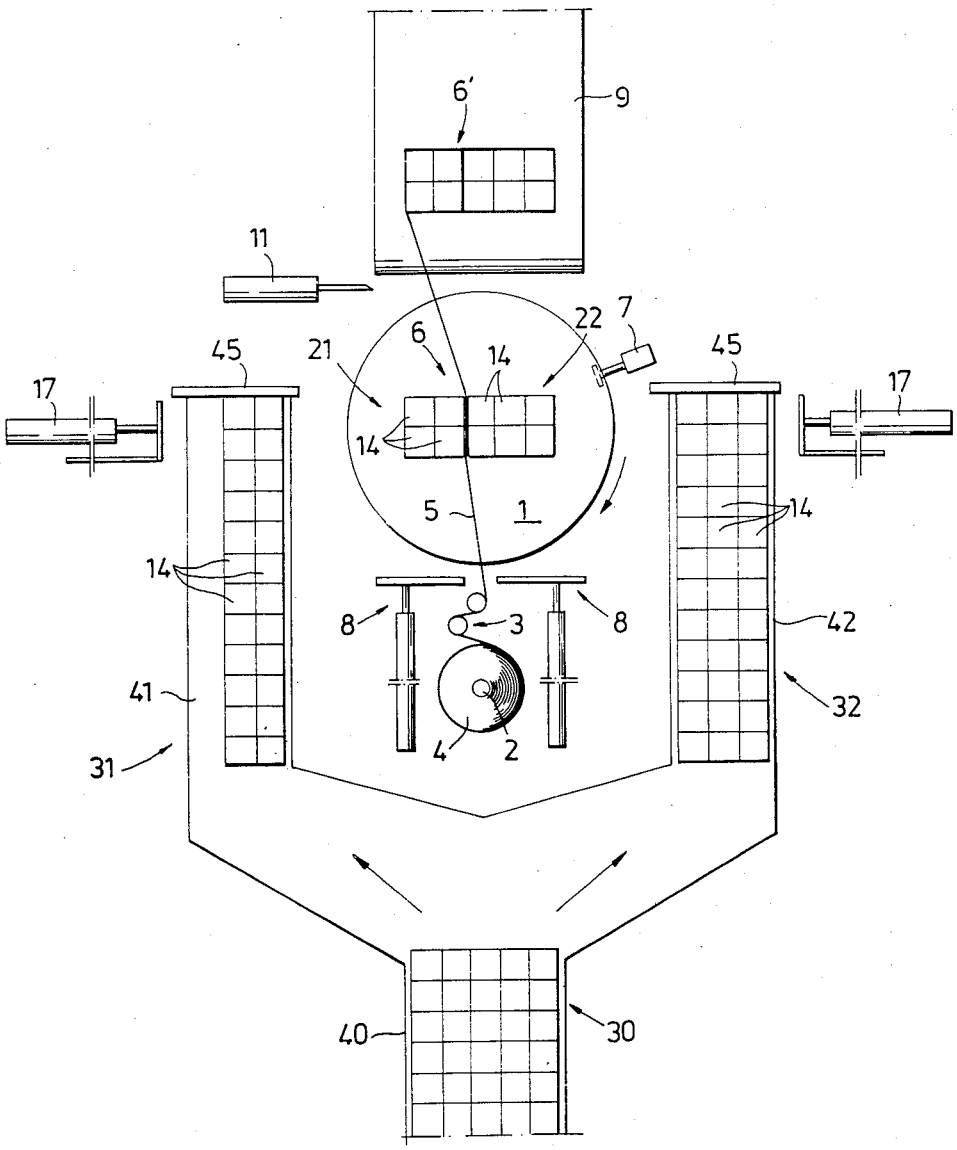
FIG. 1 is a schematic horizontal view of a stretch film wrapping apparatus in accordance with the invention.

A turntable 1 is illustrated in FIG. 1, with a holder 2 for a roll of stretch film 4, a braking means 3 for braking the stretch film 5 pulled out from the roll 4, and driving means 7 for rotating the turntable 1. The components 1–7 form a conventional stretch film wrapping apparatus. Two guided parallel pushing means 8 are also illustrated in FIG. 1. A goods aggregate 6 is shown on the turntable 1, this aggregate being formed by moving two groups 21, 22 of articles towards each other, one on either side of the film 5. The film 5 extends from the braking means 3 to a previously ready-wrapped goods aggregate 6', which is conveyed away from the turntable 1 to a discharge conveyor 9. There is further illustrated a means 11 for parting the film 5 between the ready-wrapped goods aggregate 6' and the goods aggregate 6, which has been formed and which anchors the film 5, although this aggregate has not yet been wrapped. The means 11 parts the film 5 before or in conjunction with starting wrapping of the goods aggregate 6.

The article groups 21,22 are shown as having been formed from four or six like articles 14, but it should be clear that the groups 21,22 may comprise an optional number of articles in plan, and that the groups can include articles stacked one upon the other. An article stream 30 is led in along a common conveyor path 40 and is divided with the aid of conventional means into two article streams 31 and 32 to associated conveyor paths 41 and 42 which are led to stops 45. The conveyor paths 41, 42 are suitably arranged for grouping the articles into a desired pattern, e.g. as is illustrated on the drawing, to columns having parallel rows of articles transverse the direction of the article streams 31,32. Pusher means 17 are adapted to advance article groups 21, 31 from the article columns 31,32 towards each other and towards the film 5 so that the article groups are moved together to form a goods aggregate 6 and between themselves to anchor the film 5 in the aggregate 6. The pusher means 17 and the stops 45 are shown to be disposed for forming the goods aggregate 6 on the turntable 1, but it should be clear that the goods aggregate 6 can be made up in a position between the turntable 1 and the film brake 3, and the pusher means 8 driven for advancing the newly formed goods aggregate 6 on to the turntable 1, possibly so that the ready-wrapped goods aggregate 6 on the turntable is pushed away from the turntable 1 and transferred to the discharge conveyor 9. It should furthermore be clear that the parting means 11 can be carried by one of the pusher means 17 for parting the film web 5 immediately after formation of the goods aggregate 6.

Should the goods aggregate 6 be formed outside the turntable 1, the pusher means 8 may be adapted for keeping the aggregate 6 together and thereby maintain anchorage of the film 5 in the aggregate during advance of the aggregate to the turntable 1.

Particularly when the aggregate 6 includes two or more articles in its longitudinal or width directions, the portion 5' of the film 5 clamped between the groups affords keeping together of the articles in the interior of the wrapped goods aggregate, particularly due to the stickiness of the stretch film.

An inventive apparatus is illustrated in FIG. 2, essentially agreeing with the one according to FIG. 1, the differences mainly being that the turntable 1, roll holder 2 and brake 3 have been replaced by a conventional orbiting roll holder 52 with film brake 53, and in that the pusher means 8 have been replaced by a conveyer band 58 substantially in the same plane as the base plan of the article streams 31,32.

In the apparatus according to FIG. 2, the roll holder 52 is suitably disposed such that after each wrapping operation it stops in the illustrated position.

In the inventive technique, the film 5 can be kept tensioned between the ready-wrapped goods aggregate 6' and the newly built-up goods aggregate 6 right up until the parting means 11 parts the film. The respective parted film end will snap back again, due to its tension, to the ready-wrapped goods aggregate 6' and the newly-formed goods aggregate 6, and because of the stickiness of the film it will adhere to the side surfaces of the aggregates, so that the formed film ends do not need to be manipulated further.

A ready-wrapped goods aggregate 6' is illustrated schematically in FIG. 3 and includes $4\times6$ articles 14, the film part anchored in the aggregate extending through the entire length thereof between the central article rows. It will be understood that the stretch film thus keeps the articles together in these two central rows, and that the film portion 5 lying therebetween is connected to the stretch film wrapping such that the articles lying centrally in the unit 6' cannot fall out so easily from this aggregate in a direction normal to the plane of the drawing FIG. 3.

On the drawing, the goods aggregate 6, 6' have been shown to comprise orthogonal rows of articles, but it should be clear that other configurations are possible, and it should further be clear that the number of articles in the groups can be varied as desired.

In the cases where the aggregate 6 is built up outside the wrapping position, and advancing means move the aggregate with the film anchored therein to the wrapping position, the advancing means can push away the ready-wrapped aggregate via the new aggregate, the film ends being pressed against the respective aggregate.

Of course, it may be also understood that the film may be parted while in a tensioned condition before transferring the goods aggregate to the wrapping station.

The inventive technique is particularly well suited for so-called aggregate packaging of mutually like packages of consumption articles. e.g. preserving cans, parallelepipedic packages, e.g. for liquids or powders, said package aggregates in turn being conveyed on pallets. Since the invention removes the need in the prior art of support trays, e.g. corrugated cardboard, for such package aggregates, there is not only afforded cost and handling advantages in the wrapping procedure, but both chief surfaces of the package aggregate are exposed and accessible for price notation, so that in the case where there is one course of articles, the end surfaces of the articles can be marked, and in the case of two courses of articles, marking of all the articles can be carried out without breaking the aggregate package. The articles of the aggregate need not be similar.

We claim:

1. A method of stretch film wrapping of a goods aggregate positioned in a generally horizontal plane, each aggregate including at least two articles, the method comprising the steps:

arranging a goods aggregate in a wrapping station, wrapping tensioned stretch film round the goods aggregate in the station during withdrawal of stretch film from a stretch film store, removing the wrapped goods aggregate from the station, taking a new goods aggregate to the station, anchoring the stretch film part extending between the wrapped aggregate and the store at the new goods aggregate, and parting the stretch film between the new goods aggregate and the wrapped aggregate after anchorage, including forming the new goods aggregate by moving at least two articles towards each other and into contact with both sides of the stretch film, which uninterruptedly extends between the stretch film store and the stretch film-wrapped aggregate, so that the film is anchored by being clamped between the articles of the newly formed aggregate.

2. Method as claimed in claim 1, wherein the goods aggregate is formed by moving two groups of articles towards each other into contact with both sides of the stretch film.

3. Method as claimed in claim 1, wherein the goods aggregate is wrapped with stretch film by placing the aggregate on a turntable and rotating the turntable while the film store is kept stationary.

4. Method as claimed in claim 3, wherein the goods aggregate is formed and the film is anchored in it in a position between the wrapping station and the film store, the goods aggregate with the stretch film anchored therein being subsequently transferred to the wrapping station.

5. Method as claimed in claim 4, wherein the film is parted in a tensioned condition before transferring the goods aggregate to the wrapping station.

6. Method as claimed in claim 4, wherein the new goods aggregate is caused to eject the wrapped goods aggregate in the wrapping station from the turn-table when transferring to the wrapping station from the position for building up the new goods aggregate and anchoring the film in it.

7. Method as claimed in claim 2, wherein the goods aggregate is wrapped with stretch film by placing the aggregate on a turntable and rotating the turntable while the film store is kept stationary.

8. Apparatus for stretch film wrapping of a goods aggregates positioned in a generally horizontal plane, each comprising at least two articles, including means for wrapping tensioned stretch film round a goods aggregate in a wrapping station while pulling out stretch film from a film store, means for advancing wrapped goods aggregate from the station, means for taking a new goods aggregate into the station, and for anchoring the film in the new goods aggregate, and means for parting the stretch film between the wrapped goods aggregate and the new goods aggregate after anchoring the film to the new aggregate, wherein the anchoring means includes means for moving towards each other at least two articles against both side of the film between the wrapped aggregate and the film store, the moving means being adapted to clamp the film between the articles in the new goods aggregate.

9. Apparatus as claimed in claim 8, wherein the moving means is the means for taking the aggregate into the wrapping station.

10. Apparatus as claimed in claim 8, wherein the moving means is adapted for building the goods aggregate and anchoring the stretch film in the aggregate at a position separate from the stretch film wrapping station.

11. Apparatus as claimed in claim 8, wherein the wrapping means includes a turn-table carrying the goods aggregate for rotation in the horizontal plane, and also includes a stationary holder for the film store.

12. Apparatus as claimed in claim 9, wherein the moving means is adapted for building the goods aggregate and anchoring the stretch film in the aggregate at a position separate from the stretch film wrapping station.

13. Apparatus as claimed in claim 9, wherein the wrapping means includes a turn-table carrying the goods aggregate for rotation in the horizontal plane, and also includes a stationary holder for the film store.

14. Apparatus as claimed in claim 10 wherein the wrapping means includes a turn-table carrying the goods aggregate for rotation in the horizontal plane, and also includes a stationary holder for the film store.

* * * * *